United States Patent [19]

Hogue

[11] Patent Number: 4,836,077

[45] Date of Patent: Jun. 6, 1989

[54] METHOD FOR REINFORCING THE NECK OF A VIOLIN

[76] Inventor: John H. Hogue, 436 S. Saginaw St., Flint, Mich. 48501

[21] Appl. No.: 251,799

[22] Filed: Oct. 3, 1988

[51] Int. Cl.[4] ..... G10D 1/02

[52] U.S. Cl. ..... 84/293; 84/275

[58] Field of Search ..... 84/274, 275, 291, 293

[56] References Cited

U.S. PATENT DOCUMENTS 514,877 2/1894 Back ..... 84/293 X 895,189 8/1908 Nusekabel ..... 84/274

1,841,398 1/1932 Bergh ..... 84/274

FOREIGN PATENT DOCUMENTS 1613 of 1900 United Kingdom ..... 84/275

*Primary Examiner*—Lawrence R. Franklin

*Attorney, Agent, or Firm*—Charles W. Chandler

[57] ABSTRACT

A violin having a dowel disposed in the neck block and the neck to reinforce the joint between the neck and the sound box.

3 Claims, 1 Drawing Sheet

METHOD FOR REINFORCING THE NECK OF A VIOLIN

BACKGROUND OF THE INVENTION

This invention is related to stringed instruments, such as violins, having a sound box connected to a string-supporting, neck and more particularly to a violin having a wooden dowel disposed in the neck block and the neck to reinforce the joint between the neck and the sound box against forces applied by the string means.

String instruments, such as the violin family, have strings stretched along a neck and finger board, between the sound box and the neck. The sound produced by the instrument is, in part, determined by the tautness of the strings. Higher pitched sound is produced by increasing the tautness of the strings. However, the strings apply a substantial force tending to bend the neck about its joint with the sound box. Over a period of time the tightened strings gradually weaken the glued joint between the neck block and the neck. This force amounts to about 66 pounds of pull. The strings also apply pressure to the belly board and influence its vibration characteristics.

U.S. Pat. No. 1,841,398 which issued to Bergh on Jan. 19, 1931, teaches of a practice violin having a neck connected to the sound box. Bergh employs a metal bolt for securing the body of the sound box to the neck. However, a metal bolt substantially influences the tones produced by the sound box.

SUMMARY OF THE INVENTION

The broad purpose of the present invention is to provide an improved means for reinforcing the glued joint between the sound box, the neck block and the neck of a violin by inserting a wooden dowel in the neck block and the base of the neck. The dowel is disposed at an acute angle with respect to the plane of the belly board to oppose bending forces applied by the strings.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
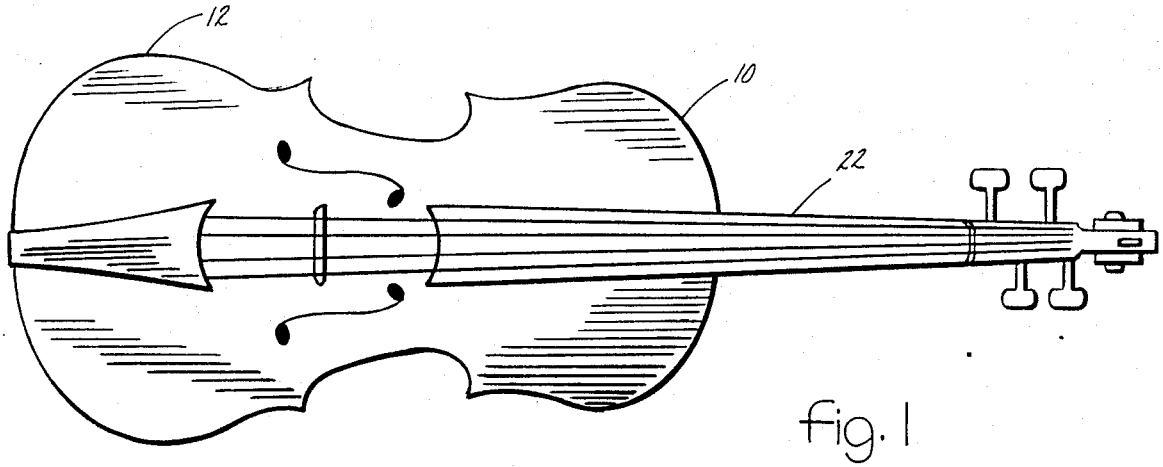
FIG. 1 is a plan view of a violin having a dowel mounted in accordance with the invention.
Figure 2:
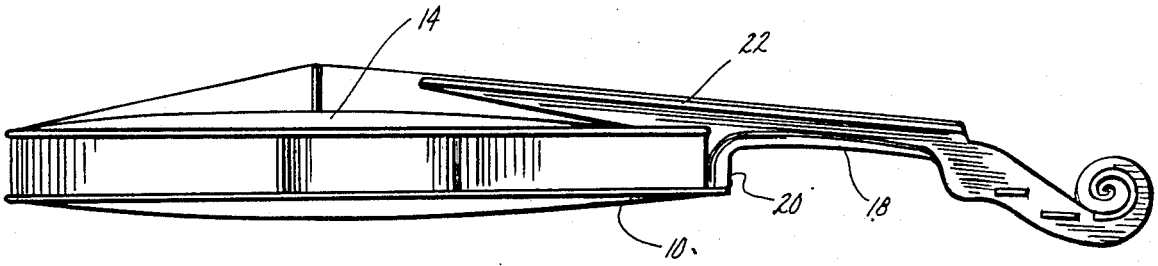
FIG. 2 is a side view of the violin of FIG. 1.

Referring to the drawings, FIGS. 1 and 2 illustrate a violin 10 having a conventional wooden sound box 12 including a wooden belly board 14 and a wooden back board 16. The belly board is generally parallel to the back board. A wooden neck 18 has a base 20 glued to one end of the sound box. Base 20 is disposed generally at right angles to the longitudinal axis of the neck. One end of the neck forms a finger board 22.

String means 24 each have one end attached at 26 to the sound box and their opposite ends attached at 28 in the conventional manner to the neck.

Figure 3:
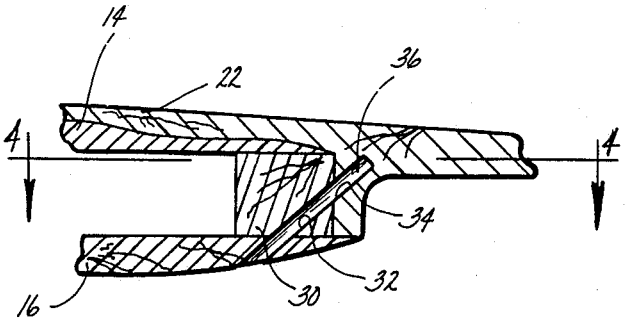
FIG. 3 is a fragmentary sectional view of the joint between the neck block and the base of the neck.
Figure 4:
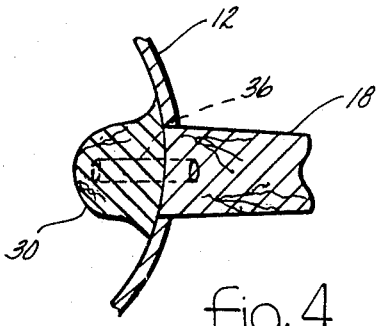
FIG. 4 is a view generally as seen along lines 4—4 of FIG. 3.

Referring to FIGS. 3 and 4, a wooden neck block 30 is mounted in the sound box and attached by a suitable adhesive to the base of the neck. The neck block has a conventional configuration, however, it also has an opening 32 aligned with an opening 34 in the neck.

A wooden dowel 36 is tightly disposed in openings 32 and 34 and substantially enclosed therein. The dowel preferably has a circular cross section, is linear and is disposed at an acute angle with respect to the belly board. The dowel is attached by a suitable adhesive to the neck and the neck block.

The dowel is disposed at an acute angle with respect to the belly board to oppose any tendency of the neck to separate from the sound box in response to the tensile force applied by the strings. As can be seen in FIG. 4, the dowel is generally aligned with the longitudinal axis of the neck. The dowel, in addition to reinforcing the joint between the neck and the neck block, opposes any tendency of the neck to apply a pressure on the belly board when the tautness of the strings is increased. In addition, the dowel being of wood, does not affect the tone of the violin, unlike a metal reinforcing member.

Having described my invention, I claim:

1. In a violin having a wooden sound box, including a wooden belly board and a wooden back board, a wooden neck connected to the sound box, and string means, first means connecting one end of the string means to the sound box and second means connecting the opposite end of the string means to the neck, and a neck block mounted in the sound box and attached to the neck, the improvement comprising:

the neck block having a first dowel-receiving opening;

the neck having a second dowel-receiving opening;

a wooden dowel tightly received in the first opening in the neck block and the second opening in the neck to reinforce the joint between the neck and the sound box in response to a force applied by the string means.

2. An improvement as defined in claim 1, in which the dowel is disposed at an acute angle with respect to the belly board, and aligned with the neck.

3. An improvement as defined in claim 1, in which one end of the dowel is disposed adjacent the back board of the sound box.

* * * * *